United States Patent [19]

Takao et al.

[11] Patent Number: 4,553,518

[45] Date of Patent: Nov. 19, 1985

[54] AIR-FUEL RATIO CONTROL FOR AN EXHAUST GAS RECIRCULATION ENGINE

[75] Inventors: Mitsunori Takao, Kariya; Takahiko Kimura, Nagoya; Norio Omori, Kariya, all of Japan

[73] Assignee: Nippondenso Co., Ltd., Kariya, Japan

[21] Appl. No.: 598,592

[22] Filed: Apr. 10, 1984

[30] Foreign Application Priority Data

Apr. 14, 1983 [JP] Japan ..... 58-66455

[51] Int. Cl.[4] ..... F02M 51/00; F02M 25/06

[52] U.S. Cl. ..... 123/478; 123/571

[58] Field of Search ..... 123/478, 480, 571, 486

[56] References Cited

U.S. PATENT DOCUMENTS 4,130,095 12/1978 Bowler et al. ..... 123/440

4,235,204 11/1980 Rice ..... 123/480 X 4,454,853 6/1984 Hasegawa ..... 123/480 X

*Primary Examiner*—Tony M. Argenbright

*Attorney, Agent, or Firm*—Cushman, Darby & Cushman

[57] ABSTRACT

An air-fuel ratio control system applicable to engines having exhaust gas recirculation (EGR). A basic amount of fuel to be injected is determined on the basis of an intake air pressure or a throttle opening. When the operating condition of an engine meets a predetermined condition for an exhaust gas recirculation control mode, a correction coefficient for the exhaust gas recirculation control mode is read from map data stored in memory means to correct the basic amount therewith. Immediately after the correction coefficient has been changed, the basic amount is corrected with a correction coefficient related to the values of the correction coefficient immediately before and after it is changed.

14 Claims, 9 Drawing Figures

8
4
41
42
43
44
45
46
E·M VALVE
15
110
AMP.
105
ROM
RAM
OUTPUT PORT
OUTPUT COUNTER
100
108
MPU
106
107
111
D
INTERRUPT CONTROL UNIT
INPUT COUNTER
104
A/D CONVERTER
101
102
A
B
C
ROTATION SENSOR
G1
G2
Ne
THROTTLE POSITION SENSOR
PRESSURE SENSOR
COOLING WATER TEMP. SENSOR
INTAKE AIR TEMP. SENSOR
7
71
72
73
10
2
11
12

FIG. 7

BASIC FUEL INJECTION AMOUNT Tp

| | | | | |
|---|---|---|---|---|
| $a_{1,1}$ | $a_{1,2}$ | --- | $a_{1,n}$ | $a_{1,n+1}$ |
| $a_{2,1}$ | $a_{2,2}$ | --- | $a_{2,n}$ | $a_{2,n+1}$ |
| ⋮ | ⋮ | | ⋮ | |
| ⋮ | ⋮ | | ⋮ | |
| $a_{n,1}$ | $a_{n,2}$ | --- | $a_{n,n}$ | $a_{n,n+1}$ |
| $a_{n+1,1}$ | $a_{n+1,2}$ | --- | $a_{n+1,n}$ | $a_{n+1,n+1}$ |

← INTAKE PRESSURE →

← ENGINE SPEED →

FIG. 8

EGR CORRECTION COEFFICIENT

| | | | | |
|---|---|---|---|---|
| $b_{1,1}$ | $b_{1,2}$ | --- | $b_{1,n}$ | $b_{1,n+1}$ |
| $b_{2,1}$ | $b_{2,2}$ | --- | $b_{2,n}$ | $b_{2,n+1}$ |
| ⋮ | ⋮ | | ⋮ | ⋮ |
| $b_{n,1}$ | $b_{n,2}$ | --- | $b_{n,n}$ | $b_{n,n+1}$ |
| $b_{n+1,1}$ | $b_{n+1,2}$ | --- | $b_{n+1,n}$ | $b_{n+1,n+1}$ |

← INTAKE PRESSURE →

← ENGINE SPEED →

AIR-FUEL RATIO CONTROL FOR AN EXHAUST GAS RECIRCULATION ENGINE

BACKGROUND OF THE INVENTION

1. Field of the Invention

The present invention relates to an arrangement including a method and an apparatus for controlling the air-fuel ratio in an internal combusttion engine having an exhaust gas recirculation system, and more particularly to a system for computing an amount of fuel to be injected into an engine through a speed-density system or a throttle-speed system.

2. Description of the Prior Art

There is known an internal combustion engine having air-fuel ratio controlled by a speed-density system which determines a basic amount of fuel to be injected on the basis of intake air pressure and engine speed (RPM). The internal combustion engine has a passage for recirculating an exhaust gas from an exhaust manifold to an intake manifold. In purifying the exhaust gas with such exhaust gas recirculation (EGR) control, the pressure in the air intake tube is determined by air drawn and a recirculated gas. Where the amount of fuel to be injected is determined using the pressure in the air intake tube directly as a parameter, the air-fuel ratio tends to render the air-fuel mixture rich.

To avoid the above drawback, there is disclosed in Japanese Laid-Open Patent Publication No. 48-27130 a system for reducing the amount of fuel to be injected dependent upon exhaust gas recirculation. This reference suggests any that it is appropriate to reduce a fuel injection amount when exhaust gas recirculation is being carried out. Fuel injection amount is determined only by intake manifold pressure and engine RPM. When exhaust gas is recirculated, the intake manifold pressure increase. Thus fuel injection amounts controlled indirectly. No sufficient study has been made of a method of setting both the amount of the recirculated gas dependent on the engine condition and while simultaneously controlling the amount of fuel to be injected at that time. The engine RPM and torque may vary and harmful components tend to be discharged with the exhaust gas when the air-fuel ratio is changed in an EGR control mode.

SUMMARY OF THE INVENTION

It is an object of the present invention to provide a method of and an apparatus for controlling the air-fuel ratio stably in an engine during an EGR control mode to thereby prevent the engine RPM and torque from being varied and suppress harmful components in an exhaust gas.

According to the present invention, a basic amount of fuel to be injected is computed on the basis of the amount of an exhaust gas being recirculated to control the air-fuel ratio of an air-fuel mixture. With a control method of the invention, a correction coefficient for the exhaust gas recirculation control mode is computed from map data stored in a memory when in the exhaust gas recirculation control mode, and the basic amount is corrected with the computed correction coefficient. The map data are divided into on a plurality of operation areas dependent on engine operation variables. When the correction coefficient being used varies across an area change point between the divided operation areas, the correction coefficient is changed in a step-like manner. If such correction coefficient were used as it is, the valve in an exhaust gas recirculation system would be delayed in operation or the transmission of a recirculated gas would be delayed with the result that the amount of fuel would be varied faster than the recirculated gas drawn into the engine cylinders to vary the air-fuel ratio. According to the present invention, immediately after the correction coefficient has been changed, a correction coefficient is determined which is related to a latest correction coefficient and a correction coefficient just before being varied, and the basic amount is corrected with the determined correction coefficient. The air-fuel ratio is thus subjected to a smaller variation by gradually changing the correction coefficient.

This invention provides an apparatus for controlling an air-fuel ratio of an engine having an exhaust gas recirculation arrangement, comprising:

(a) engine condition sensor means for detecting engine parameters including at least an air intake pressure;

(b) fuel injection means for supplying fuel to the engine;

(c) an exhaust gas recirculation system for recirculating an exhaust gas from an exhaust manifold of said engine to an intake manifold of said engine dependent on an operating condition of the engine;

(d) memory means for storing as map data fuel injection amount correction coefficients addressed by said parameters for use when the engine is operating in an exhaust gas recirculation control mode; and (e) control means for controlling said fuel injection means in response to said parameters, said control means comprising:

first means for computing a basic amount of fuel to be injected from said parameters, second means for reading a desired correction coefficient from said memory means dependent on said parameters and for determining whether the latest correction coefficient thus read is different from a previous correction coefficient, third means for correcting said basic amount with said latest correction coefficient if said latest and previous correction coefficient are the same, fourth means for determining a modified correction coefficient related to said latest and previous correction coefficients if said latest and previous correction coefficients are different from each other and for correcting said basic amount with said modified correction coefficient, and fifth means for controlling said fuel injection means so as to supply fuel based on the basic amount as corrected by either said third or fourth means.

This invention also provides a method of controlling an air-fuel ratio of an engine by controlling a supply of fuel thereto dependent on an operating condition of the engine, comprising the steps of:

(a) detecting engine operation variables including at least an intake air pressure and an engine speed;

(b) computing a basic amount of fuel to be injected as a function of said engine operation variables;

(c) searching map data stored in a memory for a correction coefficient for use in correcting the basic amount when the engine operates in an exhaust gas recirculation control mode;

(d) determining whether a latest correction coefficient read from said memory is different from a previous correction coefficient read from said memory or not;

(e) correcting said basic amount with said correction coefficients if said latest and previous correction coefficients are the same;

(f) determining a modified correction coefficient which varies dependent on a predetermined function from said previous to said latest correction coefficient if said latest and previous correction coefficients are different from each other, and correcting said basic amount with said modified correction coefficient; and (g) injecting fuel based on such basic amount as corrected in either step(e) or (f).

This invention also provides a method for controlling an air-fuel ratio of an air-fuel mixture to be supplied to an engine by controlling an amount of fuel, which is injected from an injection valve mounted on the engine, depending on operational conditions of the engine, comprising the steps of:

(a) detecting at least one engine operation variable from a group of variables including an intake air pressure and a throttle opening;

(b) computing a basic amount of fuel to be injected in accordance with the detected engine operation variable;

(c) selecting one of various possible exhaust gas recirculation (EGR) operational modes of said engine in accordance with said detected engine operation variable;

(d) reading from map data stored in a memory a correction coefficient corresponding to the selected EGR operational mode;

(e) determining whether a latest correction coefficient read from memory is different from a previous correction coefficient read there from or not;

(f) if the latest and previous correction coefficients are the same, correcting said basic amount of fuel in accordance with the latest correction coefficient;

(g) if the latest and previous correction coefficients are different from each other, modifying said previous correction coefficient in a certain time period defined between the previous and latest correction coefficients, in accordance with a predetermined function, so that said basic amount of fuel is corrected by the modified correction coefficient, whereby said basic amount of fuel is corrected by said latest correction coefficient after said certain time period; and (h) controlling the amount of fuel injected based on the basic fuel amount corrected in accordance with step (f) or (g).

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 7 is a diagram showing map data on basic amounts of fuel to be injected;

FIG. 8 is a diagram showing map data on EGR correction coefficient; and

DESCRIPTION OF THE PREFERRED EMBODIMENT

Figure 1:
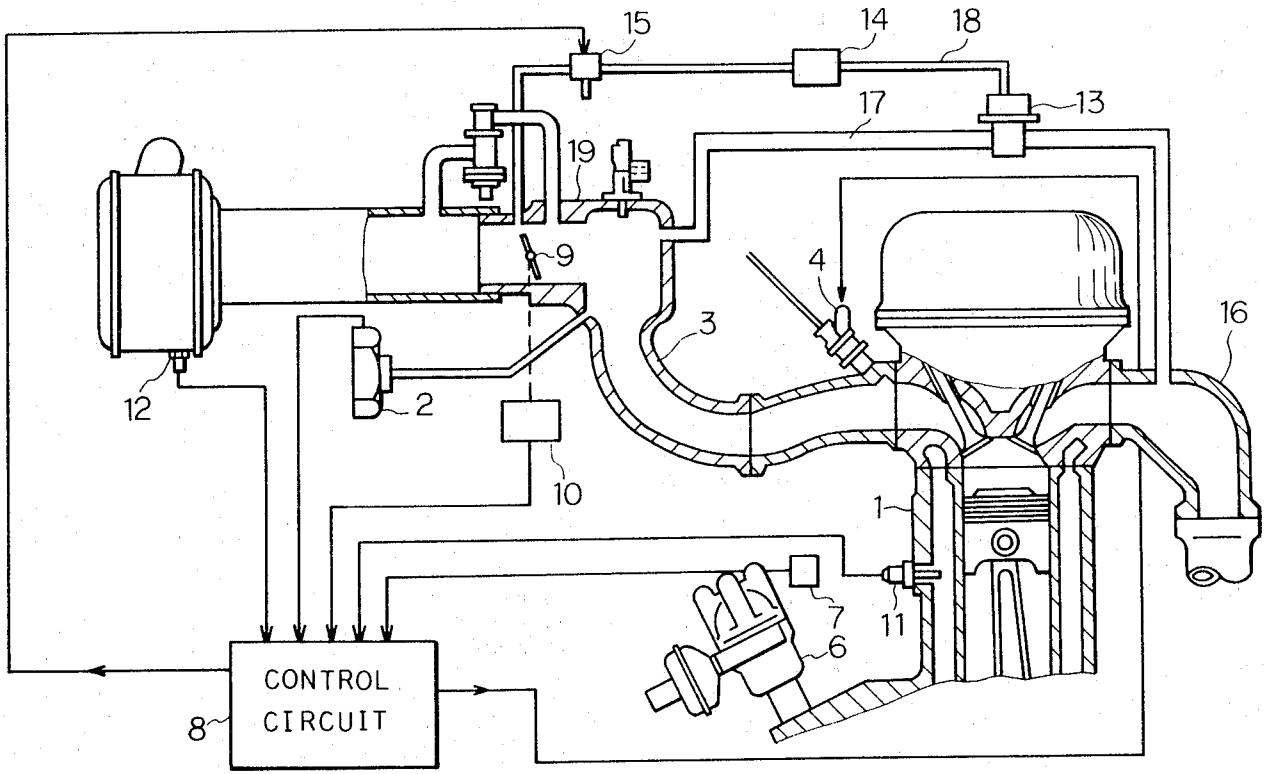
FIG. 1 is a schematic view of an internal combustion engine to which the principles of the present invention are applied and a control system for the engine.

FIG. 1 schematically shows an internal combustion engine to which the principles of the present invention are applied and a control system for the engine.

The internal combustion engine has a total of six cylinders 1 (only one shown). A pressure sensor 2 is connected to an intake manifold 3 coupled to each of the cylinders 1 for detecting the pressure of intake air in the intake manifold 3, the pressure sensor 2 comprising in the preferred embodiment a semiconductor sensor. Other types of sensors could be used in other embodiments of the invention. A solenoid-operated fuel injection valve 4 is mounted on the intake manifold 3 in the vicinity of the suction port of each cylinder 1. A distributor 6 has a rotor driven to rotate at the speed which is ½ of the engine RPM and contains a rotation sensor 7 for issuing a signal Ne indicative of the engine RPM and fuel injection timing and cylinder discriminating signals G1, G2. Designated at 9 is a throttle valve, 10 a throttle position sensor for detecting the angle of the throttle valve 11 a water temperature sensor comprising a thermistor for detecting the temperature of cooling water for the engine, and 12 an intake air temperature sensor for detecting the temperature of intake air. A vacuum-servo type exhaust gas recirculation valve (hereinafter referred to as an "EGR valve") 13 is mounted in an exhaust gas recirculation passage 17 connected between the intake manifold 3 and an exhaust manifold 16. The EGR valve 13 is controlled by a control passage 18 connected between a diaphram chamber in the EGR valve 13 and the inlet of a surge tank 19. The control passage 18 has a modulator 14 for determining the opening of the EGR valve 13 and a solenoid-operated valve 15 for switching on and off an exhaust gas recirculation mode. The solenoid-operated valve 15 is electrically connected to an output port 107 (FIG. 2) in an electronic control circuit 8. When the engine is cool, idling, or subjected to a high load, for example, the control circuit 8 applies an operation signal to the solenoid-operated valve 15 to allow the modulator 14 to be vented to atmosphere. This causes EGR valve 13 to be closed so that no exhaust gas recirculation occurs. When in the EGR mode (EGR valve 13 open), the solenoid-operated valve 15 is responsive to an operation signal from the control circuit 8 for supplying a vacuum at the inlet of the surge tank 19 adjacent to the throttle valve 9. This vacuum is supplied to the modulator 14 because the solenoid-operated valve 15 is open.

Figure 2:
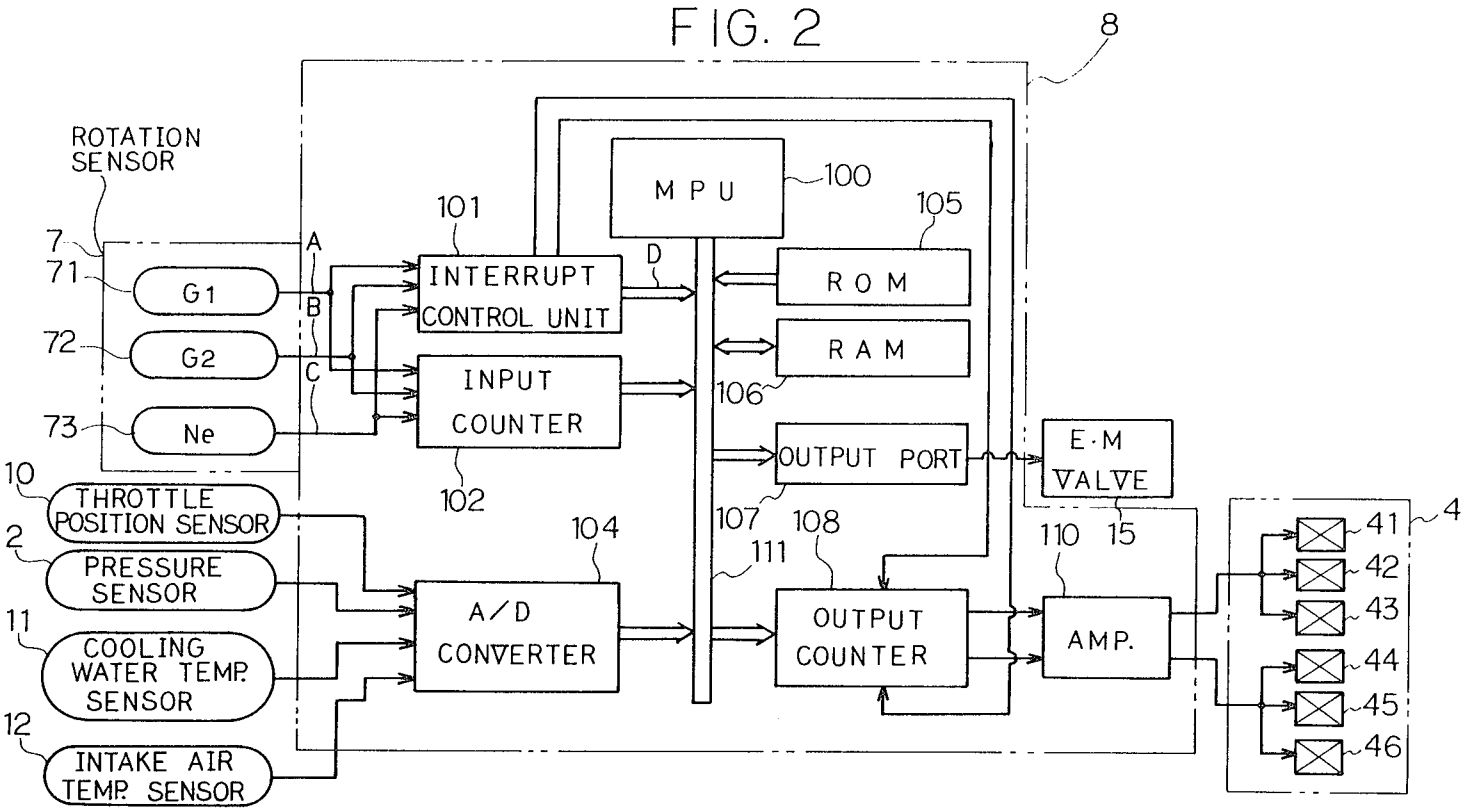
FIG. 2 is a block diagram of an electronic control circuit and various sensors connected therewith.

FIG. 2 shows in block form the electronic control circuit 8 for controlling the amount of fuel to be injected into the internal combustion engine to control the air-fuel ratio therein, and various sensors. The electronic control circuit 8 is in the preferred embodiment substantially implemented by a microcomputer.

The control circuit 8 is supplied with detected signals from the pressure sensor 2, the rotation sensor 7, the throttle position sensor 10, the cooling water temperature sensor 11, and the intake air temperature sensor 12.

It computes an amount of fuel to be injected based on these supplied data, and controls the time during which the fuel injection valves 4 are to be open to establish air-fuel ratio control. The control circuit 8 includes a microprocessor unit (hereinafter referred to as an "MPU") 100 for effecting arithmetic operations under the control of a program associated therewith, an interrup control unit 101 for issuing an interrupt signal to the MPU 100, an input counter 102 for counting rotation angle signals from the ratation sensor 7 to compute the speed of rotation of the engine, and A/D converter 104 for selectively receiving and converting the detected signals (analog signals) from the pressure sensor 2, the cooling water temperature sensor 11, and the intake air temperature sensor 12. The control circuit 8 also includes a read-only memory (ROM 105 storing the program and map data used in the arithmetic operations, a random-access memory (RAM) 106 for storing data, the RAM, 106 comprising a nonvolatile memory capable of retaining its stored data when the key switch is turned off. An output port 107 is electrically connected to the solenoid-operated valve 15. An output counter 108 includes a register for issuing a control signal to control the amount of fuel to be injected (time for which fuel is to be injected). The output counter 108 is responsive to data on the amount of fuel to be injected from the MPU 100 for determining the duty ratio fo a control pulse signal to control the time during which the fuel injection valves 4 are to be open and issue the fuel amount control signal. The control signal issued from the output counter 108 is applied through a power amplifier 110 to the fuel injection valve 4 for each engine cylinder. In the control circuit 8, the MPU 100, the interrupt control unit 101, the input counter 102, the A/D converter 104, the ROM 105, the RAM 106, the output counter 108 are connected to a common bus 111, and necessary data items are transferred through the common bus 111 under commands from the MPU 100.

Figure 3:
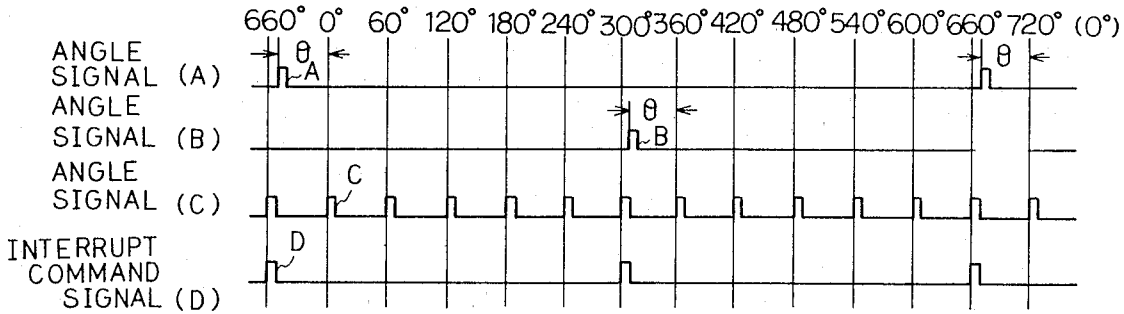
FIG. 3 is a timing chart of output signals from a rotation sensor.

The rotation sensor 7 comprises three rotation angle sensor units 71, 72, 73. As shown at (A) in FIG. 3, the first rotation angle sensor unit 71 generates an angle signal A at a giben angle $\theta$ ahead of a crank angle of 0° each time the distributor 6 makes one revolution, that is, the crank shaft makes two revolutions (through the angle of 720°). The second rotation angle sensor unit 72 generates an angle signal B at a given angle ahead of a crank angle $\theta$ of 360° each time the crank shaft makes two revolutions. The third rotation angle sensor unit 73 generates as many angle signals C as the engine cylinders at equal intervals each time the crank shaft makes one revolutions. Where the engine has six cylinders, for example, the third rotation angle sensor unit 73 produces six angle signals C at successive 60° intervals from the crank angle of 0°. The interrupt control unit 101 produces a signal by frequency-dividing the angle signal C from the third rotation angle sensor unit 73 by six and issues such a frequency-divided signal as an interrupt command signal D to the MPU 100 at each sixth pulse location after the angle signals A, B are issued from the first and second rotation angle sensor units 71, 72, that is, at each 360°. The interrupt command signal D commands the MPU 100 to effect an interrupt for computing an amount of fuel to be injected.

A method of controlling an air-fuel ratio according to the present invention will be described with reference to the flowcharts of FIGS. 4 through 6 and FIGS. 7 through 9.

Figure 4:
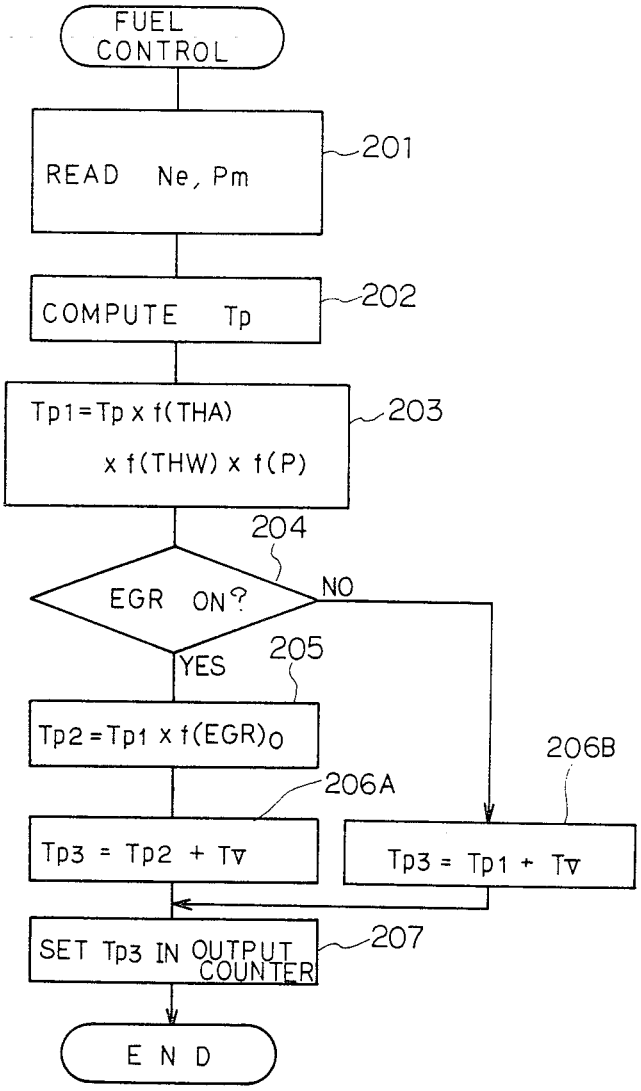
FIG. 4 is a flowchart of a routine for controlling fuel injection.

When the internal combustion engine is started, the interrupt command signal D (FIG. 3) for computing an amount of fuel to be injected is issued from the interrupt control unit 101 to the MPU 100, which then interrupts execution of the main routine and executes a fuel injection control routine shown in FIG. 4.

First, a step 201 is executed to introduce engine RPM data Ne as detected by the rotation sensor 7 via the counter 102 into the MPU 100 and also introduce pressure data Pm as detected by the pressure sensor 2 via the A/D converter 104 into the MPU 100. The program then proceeds to a next step 202 to compute a basic amount Tp of fuel to be injected based on the engine RPM and pressure data thus introduced into the MPU 100. The basic fuel amount Tp is determined by searching the map data on basic fuel amounts as shown in FIG. 7 which are stored in the ROM 105.

A step 203 is then executed to correct the basic fuel amount Tp with detected cooling water temperature data f (THW), intake air temperature data f (THA), and a transient correction coefficient f (P) when or after the engine is started to thereby computing a first amount Tp1 of fuel to be injected.

A next step 204 determines whether an EGR condition has been established. If the engine is cool, idling, or undergoes a high load, then the pregram proceeds to a step 206B.

The step 205 corrects the first fuel amount Tp1 with an EGR correction coefficient f $(EGR)_0$ computed in a routine (described later on) to determine a second amount Tp2 of fuel to be injected. The step 206A, 206B determines a final amount Tp3 of fuel to be injected by adding a corrective amount Tv related to a battery voltage to the second fuel amount Tp2 or the first fuel amount Tp1. Then, the program goes to a step 207 in which the final fuel amount Tp3 is set in the output counter 108, whereupon the control routine illustrated in FIG. 4 is completed.

Figure 5:
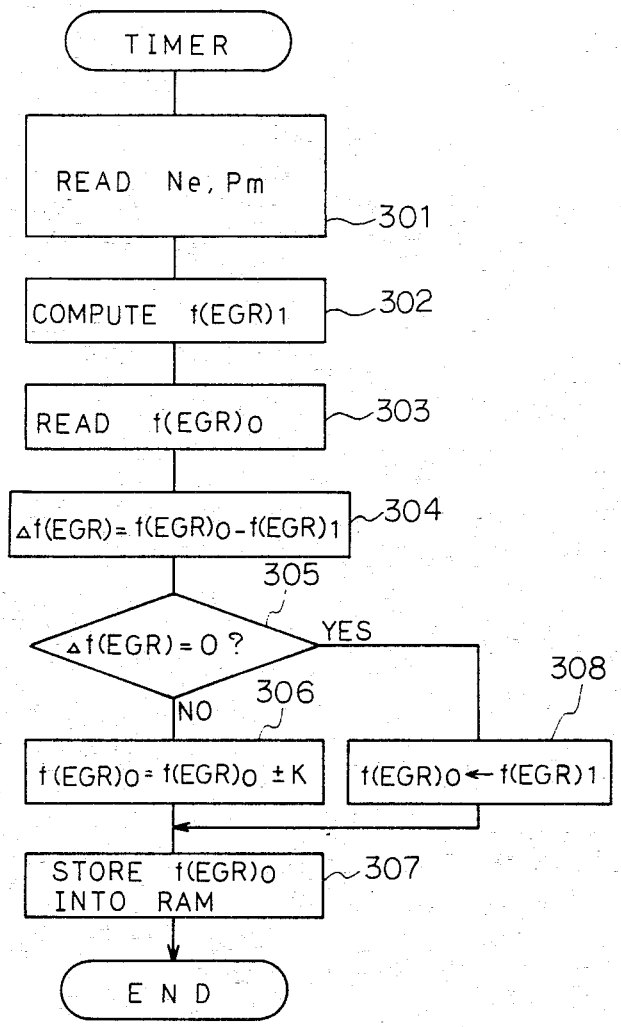
FIG. 5 is a flowchart of a timer interrupt routine for gradually varying an EGR corrective coefficient.
Figure 6:
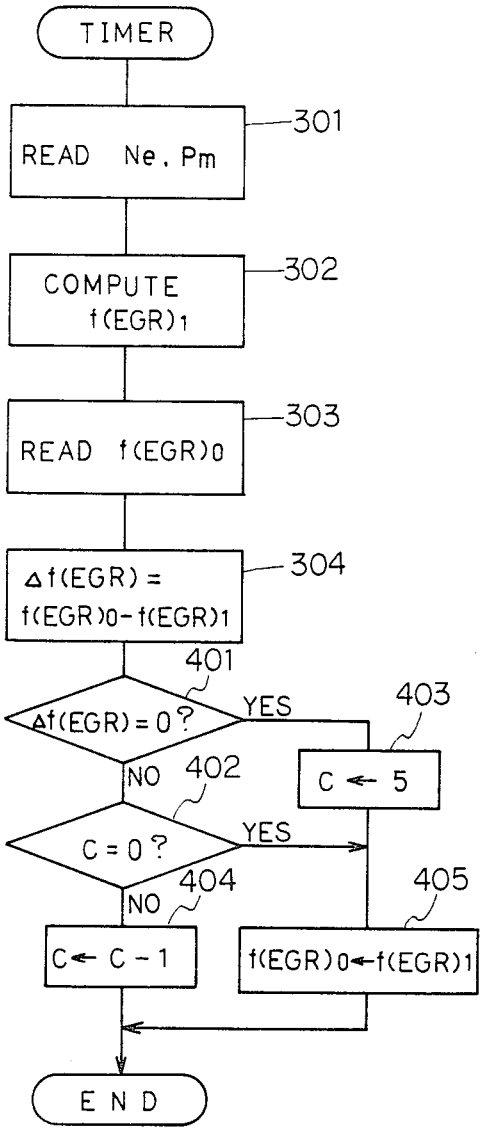
FIG. 6 is a flowchart of a timer interrupt routine for delaying the EGR correction coefficient.

The EGR correction coefficient f (EGR) used in the step 205 is computed by the timer interrupt routine, for example, shown in FIG. 5 or 6 at intervals of 10 ms and stored in the RAM 106.

The timer interrupt routine shown in FIG. 5 serves to gradually vary the EGR correction coefficient f (EGR), and the timer interrupt routine shown in FIG. 6 serves to delay the EGR correction coefficient f (EGR) for a certain interval of time, for preventing the engine RPM and torque from being abruptly changed and harmfuel components from being increased in the exhaust gas.

The control routine of FIG. 5 for gradually varying the EGR correction coefficient f (EGR) has a step 301 for introducing the engine RPM Ne and the pressure data Pm from the rotation sensor 7 and the pressure sensor 2, respectively. A step 302 searches the map data (ROM 105) of EGR correction coefficients shown in FIG. 8 for a present correction coefficient f $(EGR)_1$ with the engine RPM and the intake pressure as parameters.

Then, a step 303 is executed for introducing a previous EGR correction f $(EGR)_0$ from the RAM 106, and a step 304 is executed for determining the difference $\Delta f(EGR)$ between the previous and present correction coefficient f $(EGR)_0$, f $(EGR)_1$.

A step 305 determines whether the difference $\Delta f$ (EGR) is zero or not. If it is zero, then the program goes to a step 308 to use the present EGR correction coefficient f $(EGR)_1$ as the EGR correction coefficient f $(EGR)_0$. If it is not zero, then the program goes to a step 306 which determines the EGR correction coefficient f $(EGR)_0$ by adding a small constant K to or subtracting the same from the previous EGR correction coefficient f $(EGR)_0$. The determined EGR correction coefficient f $(EGR)_0$ is stored in the RAM 106 in a step 307 for use in the foregoing fuel injection control routine.

In an alternative embodiment, the timer interrupt routine shown in FIG. 5 can be replaced in the Timer interrupt routine shown in FIG. 6. This timer interrupt routine is for delaying the correction coefficient. In FIG. 6 it is started by executing a step 401 after the same steps 301 through 304 in the routine of FIG. 5 have been executed. The step 401 determines whether the difference Δf (EGR) between the previous and present EGR correction coefficients is zero or not. If it is zero, then a step 403 sets "5", for example, in the counter C, and a step 405 stores the present EGR correction coefficient f $(EGR)_1$ as the correction coefficient f $(EGR)_0$ in the RAM 106. If the difference Δf (EGR) is not zero, then a step 402 is executed to determine whether the count in the counter C is zero or not. If the count is zero, then the program goes to the step 405. If not, then the count in the counter C is decremented by "1" in a step 404. The routine of FIG. 6 is repeated cyclically at intervals of 10 ms, for example, so that where there is a different Δf (EGR) between the previous and present correction coefficients, a delay time of 50 ms required to decrement the counter C from "5" to "0" is introduced until the EGR correction coefficient f $(EGR)_1$ is stored as the actual correction coefficient into the RAM 106.

Figure 9:
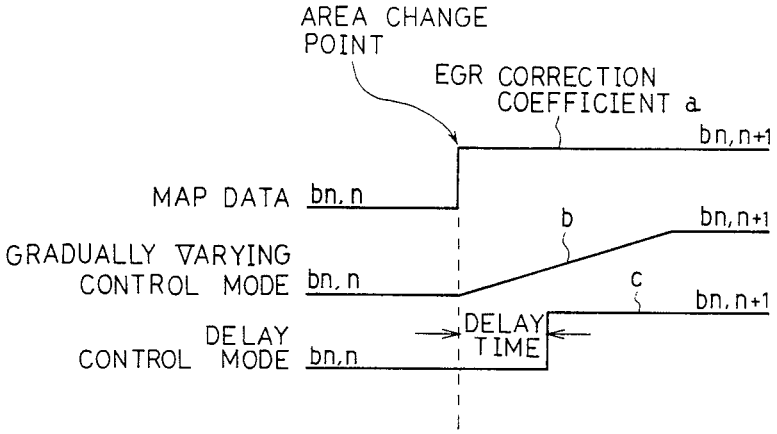
FIG. 9 is a graph showing the manner in which EGR correction coefficients vary.

With the foregoing manner of preparing the EGR correction coefficient, where the EGR correction coefficient varies as searched for in the map data varies across an area change point between divided operation areas as shown by the curve a in FIG. 9, the actual EGR correction coefficient gradually varies as shown by the curve b according to the gradually varying control mode and changes after the delay time as shown by the curve c according to the delay control mode. Since the amount of fuel to be injected is corrected by the EGR correction coefficient thus gradually changed or delayed, no abrupt variation occurs in the amount of fuel to be injected, and the air-fuel ratio is prevented from being subjected to a variation which would be caused by a gas transmission delay in the EGR control system.

The amount of fuel to be injected may be corrected by using either the gradually changing control routine or the delay control routine for computing the EGR correction coefficient f (EGR). Both routines may be executed by first executing the delay control routine before entering the gradually changing control routine. While in the foregoing embodiment the amount of fuel to be injected is controlled by the speed-density system using the intake pressure data, the present invention is also applicable to a method of controlling an air-fuel ratio for effecting fuel injection control based on a throttle-speed system in which the throttle position sensor for detecting the throttle opening is used, and a basic amount of fuel to be injected is computed from the throttle opening and the engine RPM.

Although a certain preferred embodiment has been shown and described, it should be understood that many changes and modifications may be made therein without departing from the scope of the appended claims.

What is claimed is:

1. An apparatus for controlling an air-fuel ratio of an engine having an exhaust gas recirculation (EGR) arrangement, comprising;

(a) engine condition sensor means for detecting engine parameters including at least an air intake pressure;

(b) fuel injection means for supplying fuel to the engine;

(c) an exhaust gas recirculation system for recirculating a portion of an exhaust gas from an exhaust manifold of said engine to an intake manifold of said engine as a function of an operating condition of the engine;

(d) memory means for storing as map data fuel injection amount correction coefficients addressed by said parameters for use when the engine is operating in an EGR control mode; and (e) control means for controlling said fuel injection means in response to said parameters and said correction coefficients, said control means comprising:

first means for computing a basic amount of fuel to be injected from said parameters, second means for reading a desired correction coefficient from said memory means as a function of said parameters and for determining whether the latest correction coefficient thus read is different from a previous correction coefficient, third means for correcting said basic amount with said latest correction coefficient if said latest and previous correction coefficients are the same, fourth means for determining a modified correction coefficient related to said latest and previous correction coefficients if said latest and previous correction coefficients are different from each other and for correcting said basic amount with said modified correction coefficient so that simultaneous change in the air-fuel ratio of said engine with change in the correction coefficient from the previous one to the latest one is prevented, and fifth means for controlling said fuel injection means so as to supply fuel based on the basic amount as corrected by either said third or fourth means.

2. An apparatus according to claim 1, wherein said fourth means comprises means for determining said modified correction coefficient based on a predetermined function of said previous and said latest correction coefficients.

3. An apparatus according to claim 1, wherein said fourth means comprises means for holding said previous correction coefficient for a predetermined time so that said previous correction coefficient is used as said modified correction coefficient.

4. An apparatus according to claim 1, wherein said fourth means comprises means for adding to or subtracting a predetermined value from said previous correction coefficient upon each lapse of a predetermined time to determine said modified correction coefficient gradually changing to said latest correction coefficient over a period of a plurality of such time intervals.

5. An apparatus according to claim 1, wherein said exhaust gas recirculation system comprises means for controlling an amount of said recirculating exhaust gas when the engine is operating in said exhaust gas recirculation control mode.

6. An apparatus according to claim 1, wherein said first means comprises second memory means for storing as map data said basic fuel amount so as to provide said basic amount in response to being addressed by said parameters.

7. A method of controlling an air-fuel ratio of an engine by controlling a supply of fuel thereto and an exhaust gas recirculation (EGR) from an exhaust to an intake passage of the engine, comprising the steps of:

(a) detecting an engine operation variable comprising at least one of an intake air pressure or a throttle opening;

(b) computing a basic amount of fuel to be injected as a function of said engine operation variable;

(c) searching, in accordance with said engine operation variable, map data stored in a memory means for a correction coefficient for use in correcting the basic amount, said correction coefficient being effective to reduce a change in the air-fuel ratio of said engine due to EGR;

(d) determining whether a latest correction coefficient read from said memory is different from a previous correction coefficient or not;

(e) correcting said basic amount with said latest correction coefficient if said latest and previous correction coefficients are the same;

(f) determining a modified correction coefficient related to said latest and previous correction coefficients if said latest and previous correction coefficients are different from each other, and correcting said basic amount with said modified correction coefficient so that simultaneous change in the air-fuel ratio of said engine with change in the correction coefficient from the previous one to the latest one is prevented; and (g) injecting fuel based on said basic amount as corrected in either step (e) or (f).

8. A method according to claim 7, wherein said determining step (f) comprises the step of changing gradually said previous correction coefficient to said latest correction coefficient to determine said modified correction coefficient by modifying said previous correction coefficient after each time interval of a plurality of such time intervals until said latest coefficient is reached.

9. A method according to claim 7, wherein said determining step (f) comprises the step of holding said previous correction coefficient for a predetermined time so that said previous correction coefficient is used as said modified correction coefficient.

10. A method according to claim 8, wherein said determining step (f) comprises the steps of adding to or subtacting a predetermined value from said previous correction coefficient at each lapse of a predetermined time interval to determine said modified correction coefficient gradually changing to said latest correction coefficient over a period of a plurality of such intervals.

11. A method according to claim 7, wherein said determining step (f) comprises the step of determining said modified correction coefficient according to a predetermined function of said previous correction coefficient.

12. A method of controlling an air-fuel ratio of an engine by controlling a supply of fuel thereto dependent on an operating condition of the engine, comprising the steps of:

(a) detecting engine operation variables including at least an intake air pressure and an engine speed;

(b) computing a basic amount of fuel to be injected as a function of said engine operation variables;

(c) searching, in accordance with said engine operation variable, map data stored in a memory for a correction coefficient for use in correcting the basic amount when the engine operates in an exhaust gas recirculation control mode;

(d) determining whether a latest correction coefficient read from said memory is different from a previous correction coefficient or not;

(e) correcting said basic amount with said latest correction coefficient if said latest and previous correction coefficients are the same;

(f) determining a modified correction coefficient which varies dependent on a predetermined function from said previous to said latest correction coefficients if said latest and previous correction coefficients are different from each other, and correcting said basic amount with said modified correction coefficient so that simultaneous change in the air-fuel ratio of said engine with change in the correction coefficient from the previous to the latest ones is prevented; and (g) injecting fuel based on such basic amount as corrected in either step (e) or (f).

13. A method according to claim 12, wherein said determining step (f) comprises the step of changing gradually said previous correction coefficient to said latest correction coefficient to determine said modified correction coefficient by modifying said previous correction coefficient after each time interval of a plurality of such time intervals until said latest coefficient is reached.

14. A method for controlling an air-fuel ratio of an air-fuel mixture to be supplied to an engine by controlling an amount of fuel, which is injected from an injection valve mounted on the engine, depending on operational conditions of the engine, comprising the steps of:

(a) detecting at least one engine operation variable from a group of variables including an intake air pressure and a throttle opening;

(b) computing a basic amount of fuel to be injected in accordance with the detected engine operation variable;

(c) selecting one of various possible exhaust gas recirculation (EGR) operational modes of said engine in accordance with said detected engine operation variable;

(d) reading, in accordance with said operation variable, from map data stored in a memory a correction coefficient corresponding to the selected EGR operational mode, said correction coefficient being determined to reduce change in the air-fuel ratio of said engine due to the exhaust gas recirculation;

(e) determining whether a latest correction coefficient read from said memory is different from a previous correction coefficient or not;

(f) if the latest and previous correction coefficients are the same, correcting said basic amount of fuel in accordance with the latest correction coefficient;

(g) if the latest and previous correction coefficients are different from each other, modifying said previous correction coefficient in a certain time period defined between the previous and latest correction coefficients, in accordance with a predetermined function, so that said basic amount of fuel is corrected by the modified correction coefficient, whereby said basic amount of fuel is corrected by said latest correction coefficient after said certain time period; and (h) controlling the amount of fuel injected based on the basic fuel amount corrected in accordance with step (f) or (g).

* * * * *